United States Patent [19]

Baus

[11] Patent Number: 5,031,271

[45] Date of Patent: Jul. 16, 1991

[54] RELEASABLE GUIDE ARRANGEMENT FOR SLIDING DOORS

[76] Inventor: Heinz G. Baus, 35 Wartbodenstrasse, CH-3626 Hünibach-Thun, Switzerland

[21] Appl. No.: 482,779

[22] Filed: Feb. 21, 1990

[30] Foreign Application Priority Data

Feb. 22, 1989 [DE] Fed. Rep. of Germany ..... 3905356

[51] Int. Cl.[5] ..... E06B 3/50

[52] U.S. Cl. ..... 16/90; 16/94 R; 16/95 R; 160/199; 49/159

[58] Field of Search ..... 49/410, 174, 159, 454; 16/90, 91, 93 R, 94 R, 95 R; 160/199, 207

[56] References Cited

U.S. PATENT DOCUMENTS 3,701,179 10/1972 Cox ..... 16/90

FOREIGN PATENT DOCUMENTS 1260764 9/1989 Canada .
2902288 1/1979 Fed. Rep. of Germany .
3209768 9/1983 Fed. Rep. of Germany ..... 49/410

*Primary Examiner*—Lowell A. Larson
*Assistant Examiner*—M. J. McKeon
*Attorney, Agent, or Firm*—Augustus G. Douvas

[57] ABSTRACT

A guide arrangement for a door element (14, 16), particularly a sliding door element for a shower enclosure, includes a guide element (10, 12) at the bottom edge of the door element including a rotatable member (34) engaged with a guide channel (8) of a lower guide rail (2). The guide element can be disengaged from the guide rail, when desired. The rotatable member (34) is at least partially mounted in a transverse hole (35) in a holding body so as to be at least partially rotatable about an axis of rotation extending substantially perpendicular to the plane of the door element (14, 16). The rotatable member is additionally provided with an actuator, preferably in the form of a grip (10). The rotatable member (34) carries a pintle (38) which, depending on its rotational position, either engages the guide rail (2) or is pivoted out of engagement with the guide rail.

18 Claims, 2 Drawing Sheets

FIG.3
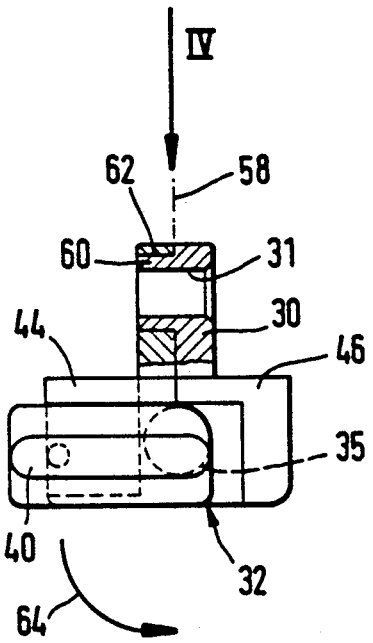
FIG.2
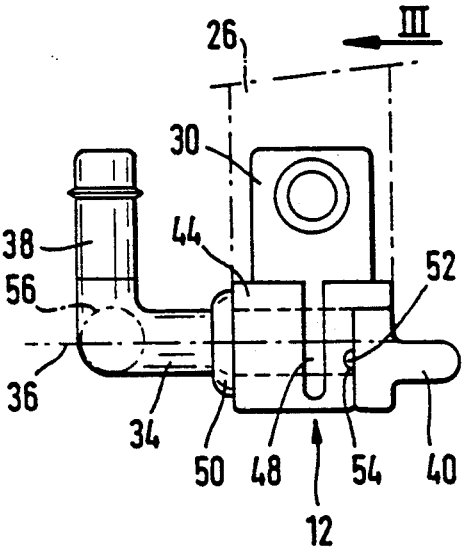
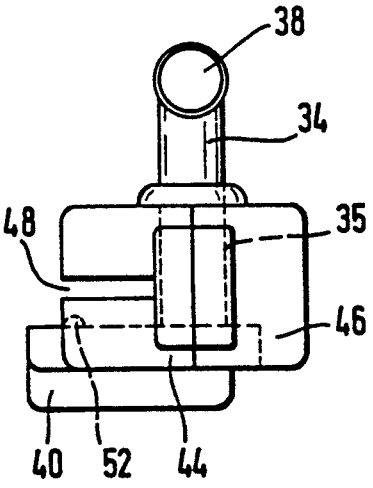
FIG.4
FIG.5
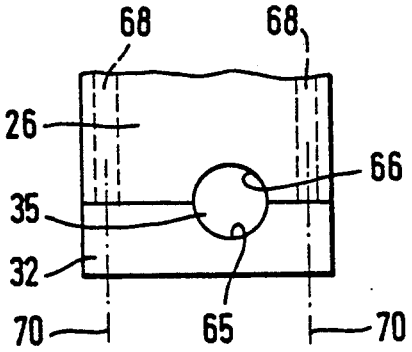

RELEASABLE GUIDE ARRANGEMENT FOR SLIDING DOORS

BACKGROUND OF THE INVENTION

The present invention relates to a guide arrangement for a displaceably suspended door element, particularly a sliding door element of a shower enclosure, having at least one guide element arranged at the bottom thereof, each comprising a rotatable member with a hook which engages in a guide channel in an adjacent lower guide rail.

A guide arrangement of this general type is disclosed in German Patent No. DE 29 02 288 B1. This guide arrangement contains a rotatable member which is rotatably arranged in an opening in the lower frame member of the door element. This opening extends over the entire width of the door element and is substantially parallel to the plane of the door element. For assembly, the rotatable member must be inserted into this opening from the side and secured by appropriate means against longitudinal displacement. Since two such rotatable members are needed for each door element, the result is an additional, and by no means negligible, amount of production and assembly work. The rotatable member is intended to compensate for dimensional variations which are mostly attributable to measurement errors which occur when the frame of the shower enclosure is installed at the work site. This is because the hook connected with the rotatable member engages a downwardly open guide channel which is only slightly deeper than the length of the hook. Because of the rotatable arrangement of the rotatable member in the opening extending in the plane of the panel, the hook can be appropriately aligned when it is installed in order to compensate for dimensional inaccuracies. A complete disengagement is neither envisioned, nor can it occur. Instead, because of the predetermined length of the hook and the depth of the lower guide channel, the door element with the hook must be inserted in the guide rail from the side and then shifted parallel to the guide rail. After that the door element can be displaced only lengthwise of the guide rail, but it is not possible to swing the door element perpendicularly to the length of the guide rail.

European Patent No. 119 614 B1 discloses a partition wall for a shower enclosure, which has an upper and a lower guide rail. A plurality of door elements are suspended and displaceably mounted in the upper guide rail. The door elements have rigid guide elements with hooks in the area of their lower edges, which engage in a guide channel in the lower guide rail. The area between the lower edges of the door elements and the lower guide rail is not readily accessible, and cleaning this area is difficult.

German Patent No. 32 09 768 A1 discloses a guide arrangement whose guide elements are mounted for vertically downward displacement on the bottom frame member of the door element. The guide elements extend over the entire width of the door element and are composed of rails of L-shaped cross section which respectively engage from underneath in one of two U-shaped guide channels in the lower guide rail. To disengage the guide elements from the U-shaped guide rail, each must be pushed vertically downwardly against the force of a spring into a lowered position. The spring is arranged in the lower frame member in which the guide elements are mounted for vertical displacement. The manufacturing and installation costs are considerable, and additional measures must be taken to mount and to secure the respective guide elements in the frame member of the door element.

SUMMARY OF THE INVENTION

It is the object of the invention to improve the guide arrangement at low manufacturing cost on the basis that, on the one hand, a stable and functionally reliable guide will be assured, and on the other hand the guide element can be easily disengaged, if necessary, from the guide rail. The manufacturing and installation costs should be small, and long lever arms, complex bearings and the like for the guide elements should be avoided. Whenever the guide element is engaged with the guide rail, a predetermined alignment between the door element and the guide rail should be assured.

These and other objects of the invention are achieved by providing a guide arrangement for a displaceably suspended door element having at least one guide element disposed at the bottom thereof, each guide element comprising a rotatable member with a hook which engages a guide channel in a lower guide rail, in which the rotatable member is mounted in a holding body so as to be at least partially rotatable about a substantially horizontal axis extending substantially perpendicularly to the plane of the door element; the rotatable member comprising at one end a radially outwardly extending pintle and at its other end on the inside of the door element an actuating means for rotating the rotatable member such that the pintle engages the guide channel or is pivoted completely out of the guide channel to permit the door element to be displaced away from the guide rail.

The proposed guide arrangement is distinguished by a simple and functionally reliable design. The guide element comprises a rotatable member with a pintle which, depending on the rotational position of the rotatable member, engages the guide rail or is disengaged from it. Connected with the rotatable member is an actuating means which is preferably configured as a handle, by which the pintle can be pivoted into or out of the guide channel, as desired. If the pintle is pivoted out of the guide channel, then the door element can be swung substantially perpendicularly away from the lower guide rail. The rotatable member is secured axially with respect to the transverse hole by securing elements in order to assure secure guidance with little free play. The transverse hole is situated at the bottom of the door element and can be at least partially arranged directly in the door element and/or in a holding body attached to the door element. Preferably, the guide arrangement is constructed as a preassembled unit which is attached to the door element, particularly to its vertical frame member, by fastening means such as screws.

If the door element comprises a vertical frame member, particularly a member of a frame for holding a sheet of transparent glass or plastic, the holding body is preferably attached to the bottom end of this vertical frame member. For this purpose the holding body may advantageously have a projection extending from underneath into a cavity in the vertical frame member, and the holding body is attached by means of a fastening element, preferably in the form of a screw, which engages this projection. The rotatable member is provided in the vicinity of the inside of the door element with a grip member, by means of which the rotatable member, and thus the pintle, are rotated to the desired position. A rotatable member configured in accord with the invention is advantageously disposed at the bottom end of the door element on each of the two vertical frame members, in order on the one hand to assure a stable and functionally reliable guidance of the door element, and on the other hand, to permit the door element to be swung away from the guide rail in a simple manner after the two rotatable members have been pivoted so that their pintles are no longer engaged in the guide rail. All of the pintles engage the same single guide channel.

In one advantageous embodiment the holding body is composed of two parts in such a way that the rotatable member can be inserted between the two parts, and after assembly of the parts the rotatable member is rotatably mounted and simultaneously axially secured in a transverse hole situated between the two parts. In such case, the rotatable member may be provided with integral securing elements, which advantageously may be configured as annular beads which engage abutment surfaces on the holding body or parts thereof.

Other preferred embodiments and advantages will be found in the embodiment described below, and in the dependent claims.

BRIEF DESCRIPTION OF THE DRAWINGS

The invention will be described hereinafter in further detail with reference to preferred embodiments illustrated in the accompanying drawings, in which:

FIG. 2 is a view of the guide element seen in viewing direction II in FIG. 1;

FIG. 3 is a view of the guide element seen in viewing direction III in FIG. 2;

FIG. 4 is a view of the guide element seen in viewing direction IV in FIG. 3; and FIG. 5 is an alternative configuration of the guide element.

DETAILED DESCRIPTION OF PREFERRED EMBODIMENTS

Figure 1:
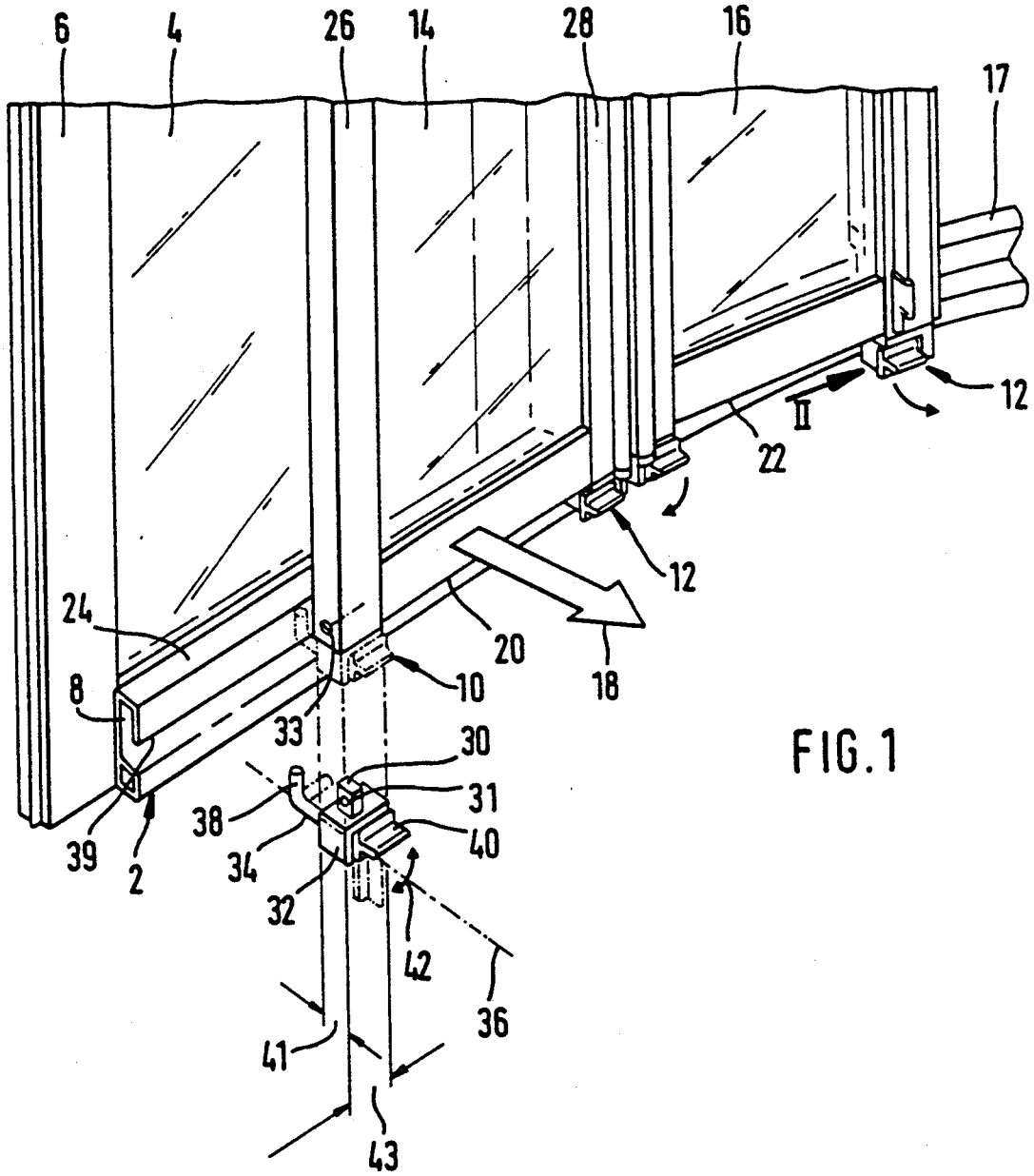
FIG. 1 is a perspective view of the guide arrangement of a shower enclosure.

FIG. 1 shows the guide arrangement provided at the bottom end of a shower enclosure with a lower guide rail 2 which can be placed in the usual manner on the margin of a shower basin. The guide rail 2 is connected to a flat wall panel 4, whose vertical lateral frame member 6 can be joined to the wall of the shower room by a compensating rail not further represented in the drawing. The guide rail 2 comprises a single, downwardly open guide channel 8 in which guide elements 10 and 12 of door elements 14 and 16 are engaged in a manner to be explained further below. These door elements 14 and 16 are suspended on an upper guide rail not shown here, which is fastened vertically above the lower guide rail 2 to the upper end of the wall panel 4. The upper and lower guide rails have a curved configuration across the entrance opening, and part of the curved portion 17 of the lower guide rail 2 can be seen on the right side of the drawing. The door elements 14 are suspended and guided so as to be displaceable along the guide rails, while their angular position with respect to one another can vary. If the two guide elements 10 and 12 are situated in the vicinity of the flat wall panel 4 and the guide rails, which are straight at that point, the two door elements 14 and 16 will lie in the same vertical plane parallel to the flat wall panel 4. If, however, the two door elements 14 and 16 are pushed toward the right into the curved portion 17 of the guide rails and the entryway of the shower enclosure which is located there, then the two planar door elements 14 and 16 will assume an angular orientation relative to one another corresponding to the curvature of the guide rail.

The guide elements 10 and 12 can be disengaged from the guide channel 8, so that the door panels 14 and 16 can be swung away from the lower guide rail 2 in the direction of the arrow 18. The bottom edges 20 and 22 of the door elements 14 and 16 are situated lower than the top edge 24 of the guide rail 2, so that a reliable, labyrinth-like seal is achieved and water spray is prevented from escaping from the shower basin. As can be seen, the guide elements 10 and 12 do not extend over the entire width of the door elements 14 and 16, but over only a small fraction of the total width. The door elements 14 and 16 each comprise two vertical frame members 26 and 28, which take the form of box rails, and one the guide elements 10 and 12 is fastened to the bottom end of each vertical frame member 26, 28.

The one guide element 10 is shown in exploded fashion displaced downwardly underneath the left vertical frame member 26 of the door element 14. The second guide element 12 is constructed in corresponding manner and is similarly situated at the bottom end of the other vertical frame member 28, so that the following explanations will also apply correspondingly to this guide element 12. Guide element 10 comprises a vertically upwardly extending projection 30 which is disposed on the top of a holding body 32, and which extends from underneath into the hollow interior of the frame member 26 and is affixed to the frame member by means of a screw 33. For this purpose, projection 30 comprises a bore 31 into which the screw 33 can be screwed. The guide element 10 contains a rotatable member 34 which is disposed for rotation about an axis 36 and which comprises a pintle 38. In the illustrated rotational position, the pintle 38 engages from underneath in the U-shaped guide channel 8 of the guide rail 2.

The rotatable member 34 comprises a grip 40 as an actuating means to permit the rotatable member to be turned. As indicated by the double arrow 42, the rotatable member 34 can be rotated on the axis 36 in such a way that the pintle 38 is rotated out of the first, vertically upwardly oriented position to the second, horizontal position illustrated here in broken lines. In this second position the pintle 38 is no longer engaged in the guide channel. The cylindrical pintle 38 and likewise the rotatable member 34 are now located below the bottom edge 39 of the common guide channel 8. If the corresponding pintle of the second guide element 12 is also rotated out of the guide channel 8, then the door element can be swung away from the guide rail 8 in the direction of the arrow 18. The axis 36 of rotatable member 34 is substantially perpendicular to the plane of the door element 14. The pintle 38 and likewise the rotatable member 34 have a substantially cylindrical cross section, and the pintle 38 is arranged substantially perpendicular to the axis of rotation 36. The actuating means, which is constructed in the form of a grip 40, is situated on the inside of the shower enclosure. Preferably, the rotatable member 34 with pintle 38 and grip 40 are fabricated integrally in one piece and inserted into the holding body 32. As a result of this integral construction of the rotatable member 34 with pintle 38 and the grip 40, a compact, space-saving and nevertheless stable construction is assured.

The holding body 32 has a depth 41 and a width 43 which are substantially the same as the depth and width, respectively, of the vertical frame member 26 of the door element 14. The holding body 32 therefore has virtually the same outside depth and width dimensions as the vertical frame member 26 and is configured as a lower extension of the vertical frame member 26. The external shape of the holding body 32 has the configuration of a substantially rectangular block or oblong, and it is attached to the bottom end of the vertical frame member 26 by means of the vertically upwardly extending projection 30. Although a holding body 32 with this oblong configuration has a compact volume and can be formed from a small amount of material, it achieves a functionally reliable mounting and support of the rotatable member 34 together with the pintle 38. The broken lines represent the pintle 38 and the grip 40 in a position rotated 90 degrees. As can be seen, the grip 40 is oriented substantially vertically, while the pintle 38 is pivoted out of the guide channel 8, so that the door element 14 can be swung away from the lower guide rail 2 in the direction of the arrow 18. For the sake of completeness it should be noted that the upper guide elements of the door elements, which are not shown here, are configured and arranged on the upper guide rail in such a way that the door elements can execute the indicated swinging movement.

FIG. 2 shows a view of the guide element 12, constructed in the form of a pre-manufactured assembly which is disposed at the bottom end of the frame member 26 which is indicated here by the broken lines. The rotatable member 34, which is rotatable about the axis 36, has taken the position in which the pintle 38 points vertically upward. The holding body comprises two parts, and the part 44, which can be seen here, is provided with a lateral slot 48 which permits a certain axial flexibility. The rotatable member 34 is situated with an annular bead 50 and with the grip 40, each contacting one axial end face of the holding body 32. The grip 40 contains a detent 52 which is held in a small detent groove 54 in part 44 of the holding body 32. Part 44 contains another similar detent groove in a position offset by 90 degrees with respect to the axis 36. By turning the grip 40 the rotatable member 34 can be turned 90 degrees, so that the pintle 38 pivots in front of the plane of the drawing and then assumes the second position indicated by the broken line 56. The detent 52 secures the pintle 38 in the illustrated position.

The two parts 44 and 46 of the holding body 32 and the grip 40 are plainly visible in FIG. 3. The projection 30 is also sectioned along the section plane 58. Section plane 58 also cuts the cylindrical transverse hole 35, so that the integrally constructed rotatable member 34 can be inserted between the two portions 44 and 46. The projection 30, which is likewise constructed in two parts, contains the bore 31, and a ring 60 on part 46 extends through an appropriately enlarged opening 62 in the other part 44. The ring 60 can be adhesively bonded or welded in the opening 62 to achieve a permanent attachment of the two parts 44 and 46. The points at which the two parts 44 and 46 are connected are spaced a sufficient distance from the rotatable member 34, that its ability to rotate cannot be impaired in any way by possible penetration of adhesive or material melted during welding. The grip 40 of the rotatable member can be pivoted downwardly as indicated by the arrow 84, so that its pintle is pivoted out of the guide channel in the lower guide rail.

The lateral slot 48 in part 44 can be clearly seen in FIG. 4. The previously mentioned detent 52 on the grip 40 and the transverse hole 35 are illustrated in broken lines.

In the embodiment described above, the transverse hole for the rotatable member is arranged in the two-piece holding body. It is also within the scope of the invention to provide the transverse hole, either completely or partially, directly in the frame members of the door element.

FIG. 5 shows an alternative embodiment of this type in which the holding body 32 is constructed in a single piece. The viewing direction is the same as in FIG. 3. Here both the holding body 32 and the frame member 26 are provided with oppositely disposed semicylindrical recess portions 65 and 66 which together form the transverse hole 35 for the rotatable member which is not shown here. The parting plane of the transverse hole 35 is substantially horizontal. The holding body 32 is attached in a suitable manner to the frame member 26. For this purpose, the frame member may be provided in its interior with one, or preferably two, screw holes 68. As indicated by the lines 70, screws are screwed from underneath through the holding body 32 into the screw holes 68 to fasten the holding body to the bottom end face of the frame member 26. The rotatable member with the pintle and the grip otherwise has the same construction as in FIGS. 1 to 4. The holding body 32 again has a compact, oblong shape and is fastened to the bottom end of the vertical frame member 26 as an extension. Due to the oblong shape of the holding body 32, a functionally reliable and stable mounting and attachment of the rotatable member is assured.

The foregoing description and examples have been set forth merely to illustrate the invention and are not intended to be limiting. Since modifications of the described embodiments incorporating the spirit and substance of the invention may occur to persons skilled in the art, the scope of the invention should be construed to include all modifications falling within the ambit of the appended claims and equivalents thereof.

What is claimed is:

1. A guide arrangement for a displaceably suspended door element (14, 16) having at least one guide element (10, 12) disposed at the bottom thereof, each said guide element comprising a rotatable member with a hook which engages a guide channel (8) in a lower guide rail (2), wherein said rotatable member (34) is mounted in a holding body (32) so as to be at least partially rotatable about an axis (36) extending substantially perpendicularly to the plane of said door element (14, 16); said rotatable member (34) comprising at one end a radially outwardly extending pintle (38) and at its other end on the inside of the door element (14, 16) an actuating means for rotating said rotatable member (34) such that said pintle (38) engages said guide channel (8) or is pivoted completely out of said guide channel (8) to permit said door element (14, 16) to be displaced away from said guide rail (2).

2. A guide arrangement according to claim 1, wherein said door element is a sliding door of a shower enclosure.

3. A guide arrangement according to claim 1, wherein said actuating means comprises a grip member (40) formed on said rotatable member (34).

4. A guide arrangement according to claim 1, wherein said guide rail (2) comprises a single, common guide channel (8) for at least two door elements, said single guide channel being engaged by rotatably disposed pintles (38) of all the guide elements (10, 12) of said door elements.

5. A guide arrangement according to claim 1, further comprising a grip (40) arranged on an end of said rotatable member (34) remote from said guide rail (2) for pivoting said pintle (38) into or out of said guide channel (8) of said guide rail (2).

6. A guide arrangement according to claim 1, wherein said pintle (38) is arranged on one end of said rotatable member (34) oriented at an angle of approximately 90 degrees with respect to said axis of rotation (38).

7. A guide arrangement according to claim 1, wherein said rotatable member (34), said pintle (38) and said grip (40) are constructed in a single piece as an integral component.

8. A guide arrangement according to claim 1, wherein a detent (52) is provided on said rotatable member (34) which snaps into a detent groove (54) in said holding body (32) when said pintle is pivoted so as to engage the lower guide rail (2), thereby securing said rotatable member (34) against unintentional rotation.

9. A guide arrangement according to claim 1, wherein said lower guide rail (2) comprises a downwardly open, U-shaped guide channel (8), and when said pintle (38) is pivoted to engage said lower guide rail (2), the pintle (38) is vertically oriented and engages from underneath in said U-shaped guide channel (8).

10. A guide arrangement according to claim 9, wherein said rotatable member (34) is rotatable about a substantially horizontal axis of rotation (36), and when said rotatable member (34) is turned to disengage said pintle (38) from said lower guide rail (2), the pintle is moved to a position below a bottom edge (39) of said downwardly open, U-shaped guide channel (8).

11. A guide arrangement according to claim 1, wherein said rotatable member (34) is rotatable about a substantially horizontal axis of rotation (36), and when said rotatable member (34) is pivoted to disengage said pintle (38) from said lower guide rail (2), the pintle is oriented substantially horizontally.

12. A guide arrangement, according to claim 1, wherein a holding body (32) is arranged at the bottom of a vertical frame member (26) of said door element, and said rotatable member (34) is received in a transverse hole (35) formed at least partially in said holding body (32).

13. A guide arrangement according to claim 12, wherein said holding body (32) corresponds substantially in depth (41) and width (43) to said vertical frame member (28).

14. A guide arrangement according to claim 12, wherein said transverse hold (35) is defined by two parts (44, 46) of said holding body (32), and said rotatable member (34) is inserted in said transverse hole between said two holding body parts.

15. A guide arrangement according to claim 12, wherein said transverse hole (35) is defined by oppositely disposed semicylindrical recesses (65, 66) formed respectively in said holding body and in the bottom of said frame member (26), and said rotatable member (34) is inserted in said transverse hole between said holding body and said frame member.

16. A guide arrangement according to claim 12, wherein said rotatable member (34) is secured against axial movement with respect to said holding body (32) in the direction of said axis of rotation (38).

17. A guide arrangement according to claim 16, wherein an annular bead (50) on said rotatable member engages an axial contact surface on one side of the holding body (32), and a grip (40) on said rotatable member engages a second axial contact surface on the other side of the holding body (32).

18. A guide arrangement according to claim 12, wherein said holding body (32) comprises an extension (30) which projects into a cavity in , and is attached to, the frame member (26).

* * * * *